US011319736B2

(12) United States Patent
Thomas

(10) Patent No.: US 11,319,736 B2
(45) Date of Patent: May 3, 2022

(54) SWING BAR DOOR GUARD

(71) Applicant: Scott Thomas, Maumee, OH (US)

(72) Inventor: Scott Thomas, Maumee, OH (US)

(73) Assignee: QUIET LOCK CORPORATION, Carlstadt, NJ (US)

( * ) Notice: Subject to any disclaimer, the term of this patent is extended or adjusted under 35 U.S.C. 154(b) by 776 days.

(21) Appl. No.: 16/116,387

(22) Filed: Aug. 29, 2018

(65) Prior Publication Data

US 2019/0071903 A1 Mar. 7, 2019

Related U.S. Application Data

(60) Provisional application No. 62/553,225, filed on Sep. 1, 2017.

(51) Int. Cl.
*E05C 17/16* (2006.01)
*E05B 17/00* (2006.01)

(52) U.S. Cl.
CPC ..... *E05C 17/166* (2013.01); *E05B 17/0045* (2013.01)

(58) Field of Classification Search
CPC .... E05C 17/166; E05C 19/184; E05C 19/182; E05C 19/18; E05C 19/08; E05C 17/00; E05C 17/02; E05C 17/04; E05C 17/047; E05C 17/16; E05C 17/54; E05B 17/0045; E05B 17/2023; E05B 17/20; E05B 17/2088; E05B 17/2084; E05B 65/0032; E05B 65/0035; E05B 65/48; E05B 65/5284; E05B 65/52; E05B 65/84; E05B 63/12; E05B 63/128; E05B 67/38; E05B 67/383; E05B 77/44; Y10T 292/03; Y10T 292/34; Y10T 292/37; Y10T 292/28; Y10T 292/289; Y10T 292/15; Y10T 292/304;

(Continued)

(56) References Cited

U.S. PATENT DOCUMENTS 4,062,578 A * 12/1977 Chen ..... E05C 17/166 D8/336
6,343,818 B1 * 2/2002 Kuramochi ..... E05C 17/166 49/386

(Continued)

FOREIGN PATENT DOCUMENTS

JP 2559590 Y2 9/1992
JP 06-047554 U 6/1994

(Continued)

OTHER PUBLICATIONS

Extended European Search Report from corresponding International Application No. EP18850126.6, dated May 10, 2021, 27pages.

(Continued)

*Primary Examiner* — Kristina R Fulton
*Assistant Examiner* — Tal Saif
(74) *Attorney, Agent, or Firm* — Tucker Ellis LLP

(57) ABSTRACT

A swing bar door guard includes a door latch having a latch base configured to be connected to a door jamb, a latch bar configured to be connected to the latch base, and first and second bumpers configured to extend through openings in the latch bar. The first and second bumpers each include a jamb bumper portion for contacting the door jamb when in a blocking position and a door bumper portion for contacting the door in the blocking position.

14 Claims, 19 Drawing Sheets

(58) Field of Classification Search
CPC ..... Y10T 292/288; Y10T 292/281; Y10S 292/15; Y10S 292/1086
See application file for complete search history.

(56) References Cited

U.S. PATENT DOCUMENTS

| | | | | |
|---|---|---|---|---|
| 7,360,804 | B1 | 4/2008 | Fidali et al. | |
| D643,278 | S * | 8/2011 | Fidali | D8/343 |
| 2008/0150299 | A1* | 6/2008 | Fidali | E05C 17/166 292/1 |
| 2008/0224484 | A1* | 9/2008 | Yates | E05C 17/54 292/262 |
| 2010/0156121 | A1* | 6/2010 | Badia | E05B 17/007 292/216 |
| 2012/0223535 | A1* | 9/2012 | Yates | E05C 17/54 292/288 |
| 2015/0097381 | A1* | 4/2015 | Hwang | E05C 17/166 292/262 |
| 2016/0362911 | A1* | 12/2016 | Sussman | E05B 17/0041 |
| 2018/0163445 | A1* | 6/2018 | Kingsbury | E05C 17/166 |

FOREIGN PATENT DOCUMENTS

| | | | | |
|---|---|---|---|---|
| JP | 0647554 | U | 6/1994 | |
| JP | H0647554 | U * | 6/1994 | |
| JP | H0647555 | B2 * | 6/1994 | A61K 38/005 |
| JP | 06-083878 | U | 12/1994 | |
| JP | H0683878 | U * | 12/1994 | |
| JP | 07-016879 | U | 3/1995 | |
| JP | 0714054 | U | 3/1995 | |
| JP | H0716879 | U * | 3/1995 | |
| JP | 3013988 | U | 7/1995 | |
| JP | 2001090419 | A * | 4/2001 | |
| JP | 4994308 | B2 * | 8/2012 | |
| RU | 2514487 | C1 | 4/2014 | |

OTHER PUBLICATIONS

International Search Report and Written Opinion from corresponding International Application No. PCT/US2018/048542, dated Dec. 12, 2018, 13 pages.
International Preliminary Report on Patentability from corresponding International Application No. PCT/US2018/048542, dated Mar. 12, 2020, 10 pages.
Chinese Office Action from corresponding Application No. 201880056976.7, dated Jun. 18, 2021, 8 pages.
Russian Office Action from corresponding Application No. 2020112526, dated Dec. 3, 2021, 5 pages.

* cited by examiner

SWING BAR DOOR GUARD

RELATED APPLICATIONS

This application claims the benefit of U.S. Provisional Application No. 62/553,225 filed Sep. 1, 2017, which is hereby incorporated herein by reference.

FIELD OF INVENTION

The present invention relates generally to swing bar door guards, and more particularly to noise dampening swing bar door guards.

BACKGROUND

Door hook and latch combinations, sometimes referred to as swing bar door locks, are common items for securing doors. To prevent a door from closing, for example hotel doors that close automatically, users often move the door latch between a door jamb and the door, resulting in the door impacting the door latch as it closes.

SUMMARY OF INVENTION

The present application is directed to a swing bar door guard including a door latch having a latch base configured to be connected to a door jamb, a latch bar configured to be connected to the latch base, and first and second bumpers configured to extend through openings in the latch bar. The first and second bumpers each include a jamb bumper portion for contacting the door jamb when in a blocking position and a door bumper portion for contacting the door in the blocking position.

In an embodiment, a swing bar door guard is provided that includes a door latch including a latch base configured to be connected to a door jamb, a latch bar configured to be connected to the latch base, and at least one bumper removably attached to the latch bar, the at least one bumper having a jamb bumper portion and a door bumper portion, and a door hook configured to be connected to a door, wherein the latch bar is movable between an unlatched position to allow opening and closing of the door, a latched position to prevent full opening of the door, and a blocking position to prevent closing of the door, and wherein in the blocking position, the jamb bumper portion contacts the door jamb and the door bumper portion contacts the door.

In another embodiment, a door latch for use with a door hook is provided that includes a latch bar including a body having a pair of parallel bar members, a protrusion extending from a top surface of each of the parallel bar members, an opening extending through each parallel bar member and respective protrusion, an ear extending from ends of each parallel bar member, and an opening extending through each ear for connecting the latch bar to a latch base, and a pair of bumpers configured to extend through a respective one of the openings, each bumper including a jamb bumper portion configured to contact a door jamb and a door bumper portion configured to contact a door.

In still another embodiment, a swing bar door guard is provided that includes a door latch including a latch base configured to be connected to a door jamb, a latch bar configured to be connected to the latch base, and at least one bumper coupled to the latch bar, wherein the latch bar is movable between an unlatched position to allow opening and closing of the door, a latched position to prevent opening of the door, and a blocking position to prevent closing of the door, and wherein in the blocking position, the at least one bumper contacts the door.

The foregoing and other features of the application are described below with reference to the drawings.

DETAILED DESCRIPTION

Figure 1:
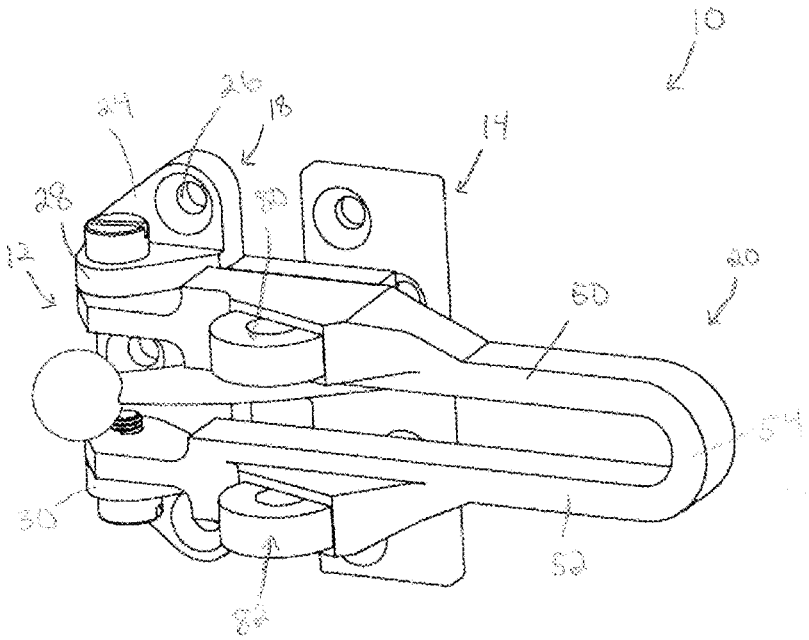
FIG. 1 is a perspective view of an exemplary swing bar door guard in a latched position.
Figure 2:
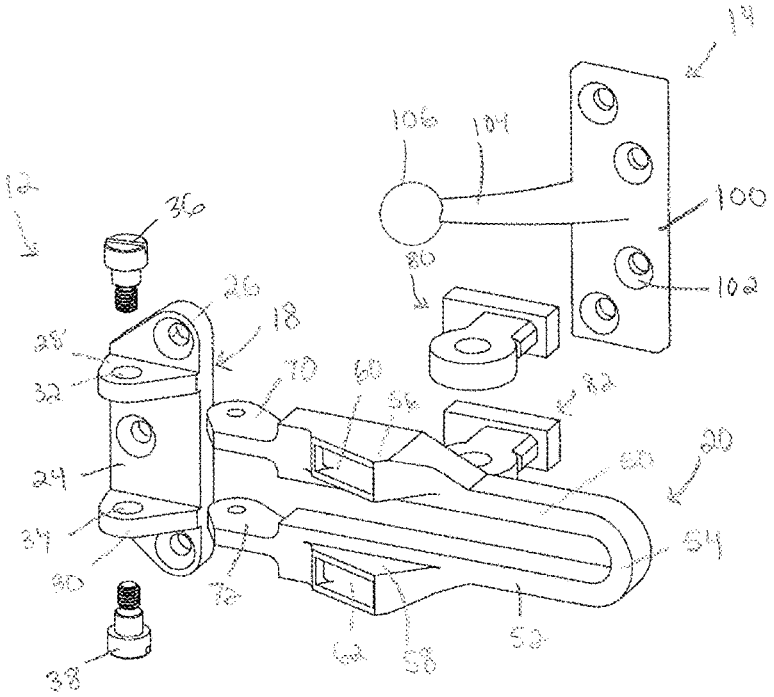
FIG. 2 is an exploded view of the swing bar door guard.
Figure 3:
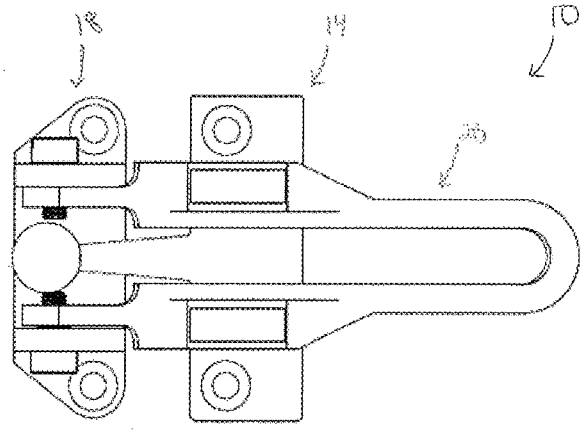
FIG. 3 is front view of the swing bar door guard in the latched position.
Figure 4:
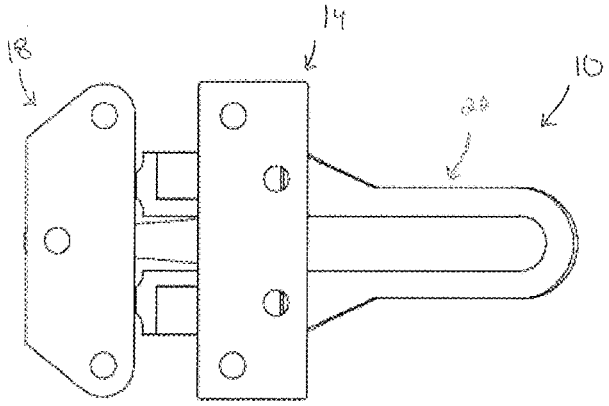
FIG. 4 is a rear view of the swing bar door guard in the latched position.
Figure 5:
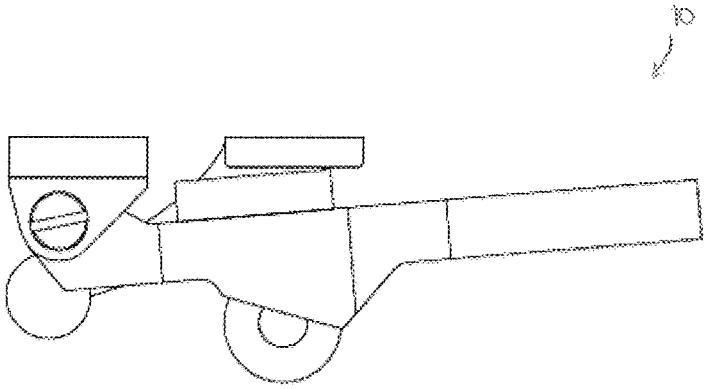
FIG. 5 is a top view of the swing bar door guard in the latched position.
Figure 6:
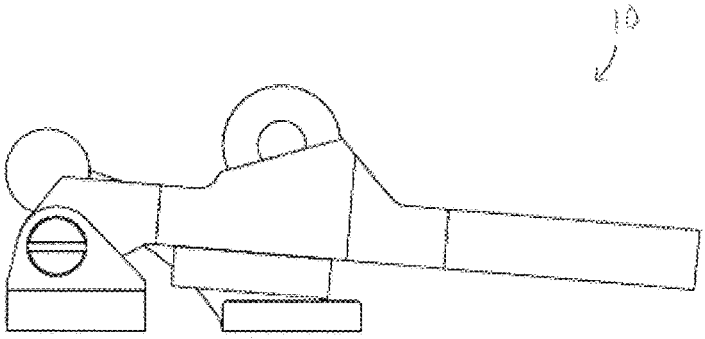
FIG. 6 is a bottom view of the swing bar door guard in the latched position.
Figure 7:
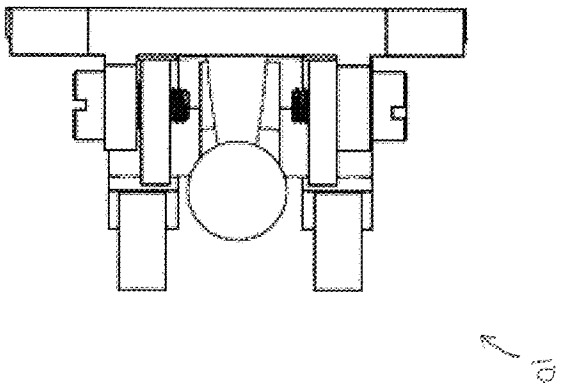
FIG. 7 is a left side view of the swing bar door guard in the latched position.
Figure 8:
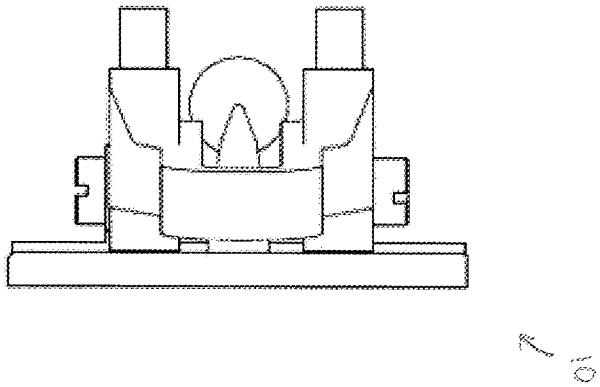
FIG. 8 is a right side view of the swing bar door guard in the latched position.

Referring to FIGS. 1-10, a swing bar door guard is shown generally at reference numeral 10. The swing bar door guard 10 is shown in a latched position and includes a door latch 12 configured to engage a door hook 14 to secure a door 16 in a latched position. The door latch 12 includes a latch base 18 configured to be connected to a door jamb 22 and a latch bar 20 pivotally connected to the latch base 18.

Referring additionally to FIGS. 11-14, the latch base 18 includes a body 24 having a bottom surface that abuts the door jamb 22 and one or more openings 26, such as three openings as shown, for receiving fasteners to secure the body 24 to the door jamb 22. The openings 26 can be countersunk to receive a head of the fasteners. The latch base 18 also includes a pair of ears 28 and 30 extending from a top surface of the body 24 parallel to one another and spaced from one another along a length of the body 24. Each ear 28, 30 includes a respective opening 32, 34 for receiving a respective fastener 36, 38 for securing the latch bar 20 to the latch base 18.

Figure 17:
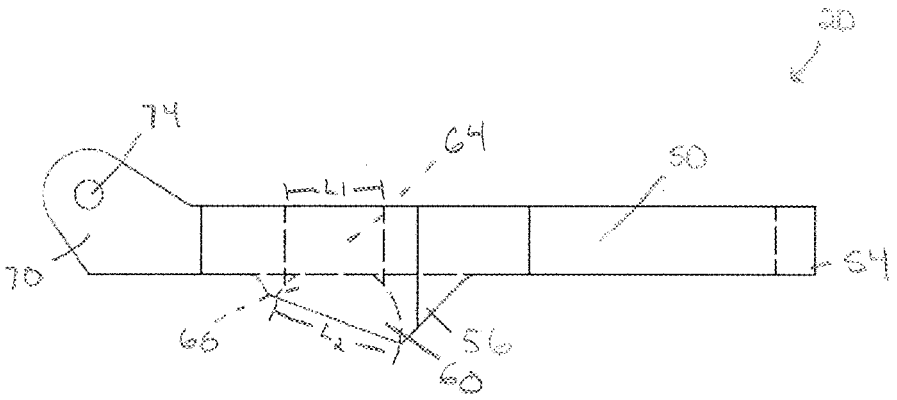
FIG. 17 is a top view of the latch bar.
Figure 18:
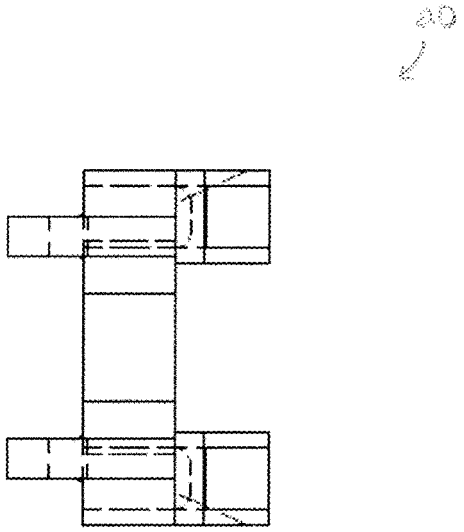
FIG. 18 is a left side view of the latch bar.
Figure 19:
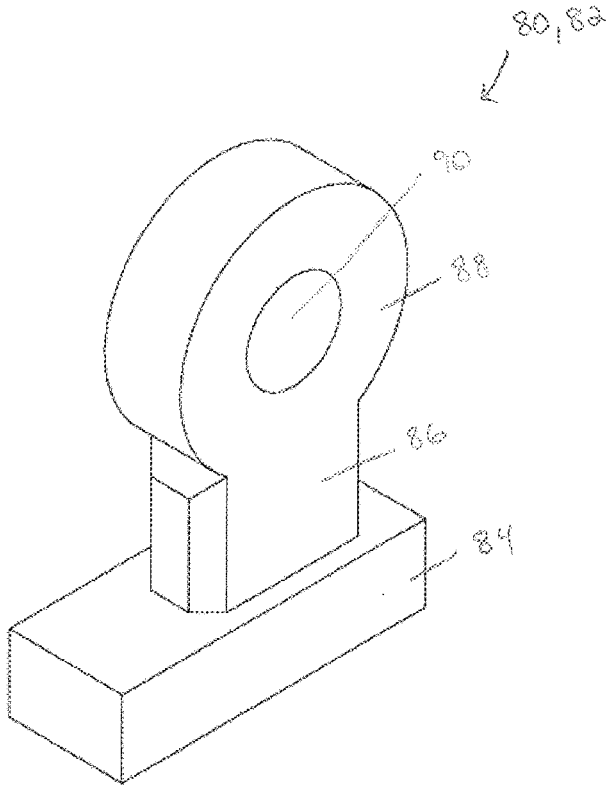
FIG. 19 is a perspective view of a bumper of the swing bar door guard.
Figure 20:
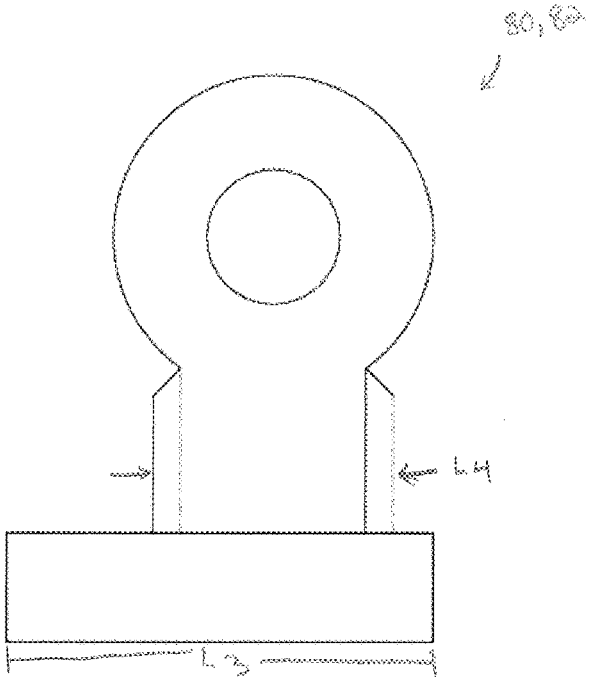
FIG. 20 is a front view of the bumper.
Figure 21:
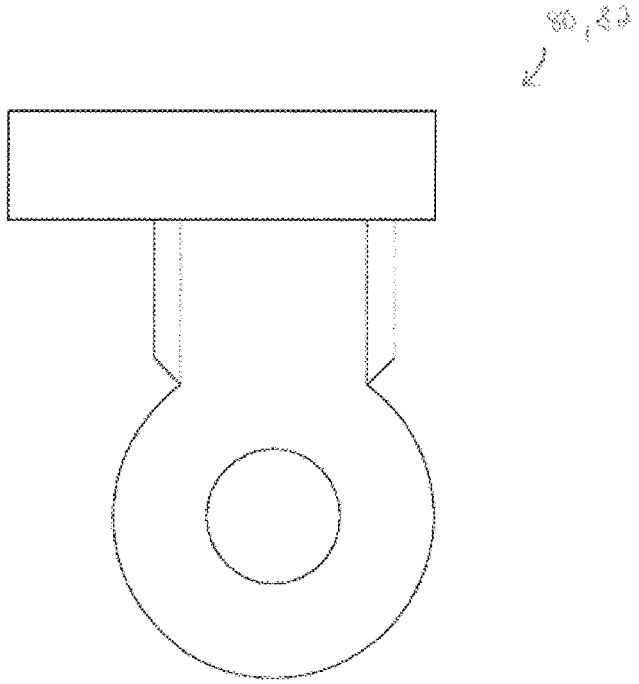
FIG. 21 is a rear view of the bumper.
Figure 22:
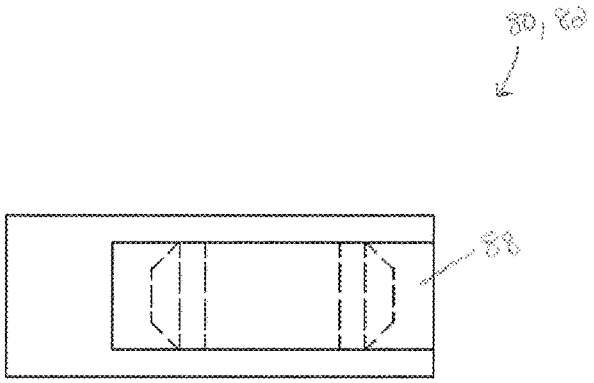
FIG. 22 is a top view of the bumper.
Figure 23:
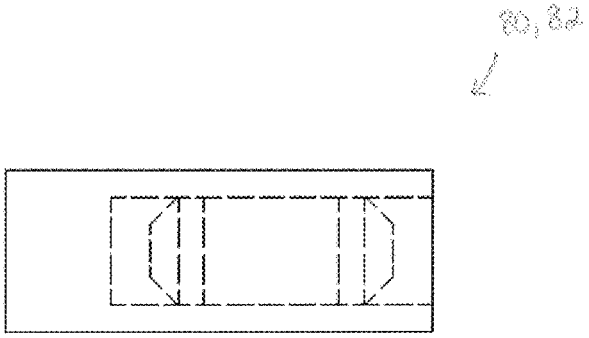
FIG. 23 is a bottom view of the bumper.
Figure 24:
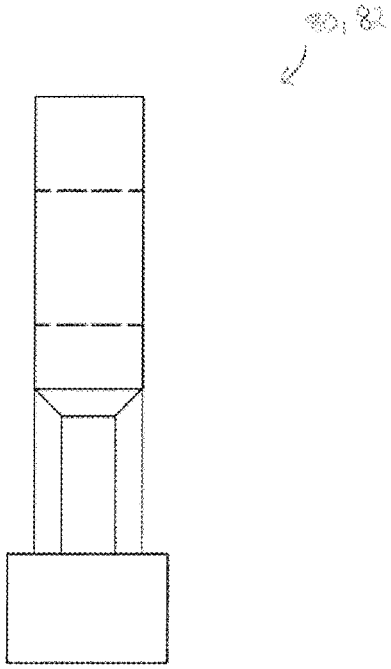
FIG. 24 is a left side view of the bumper.
Figure 25:
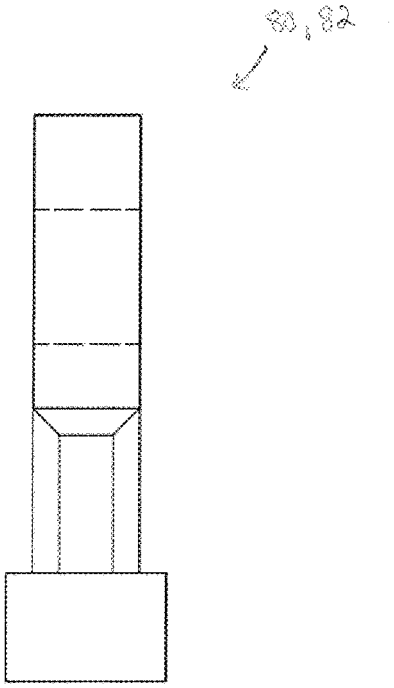
FIG. 25 is a right side view of the bumper.
Figure 26:
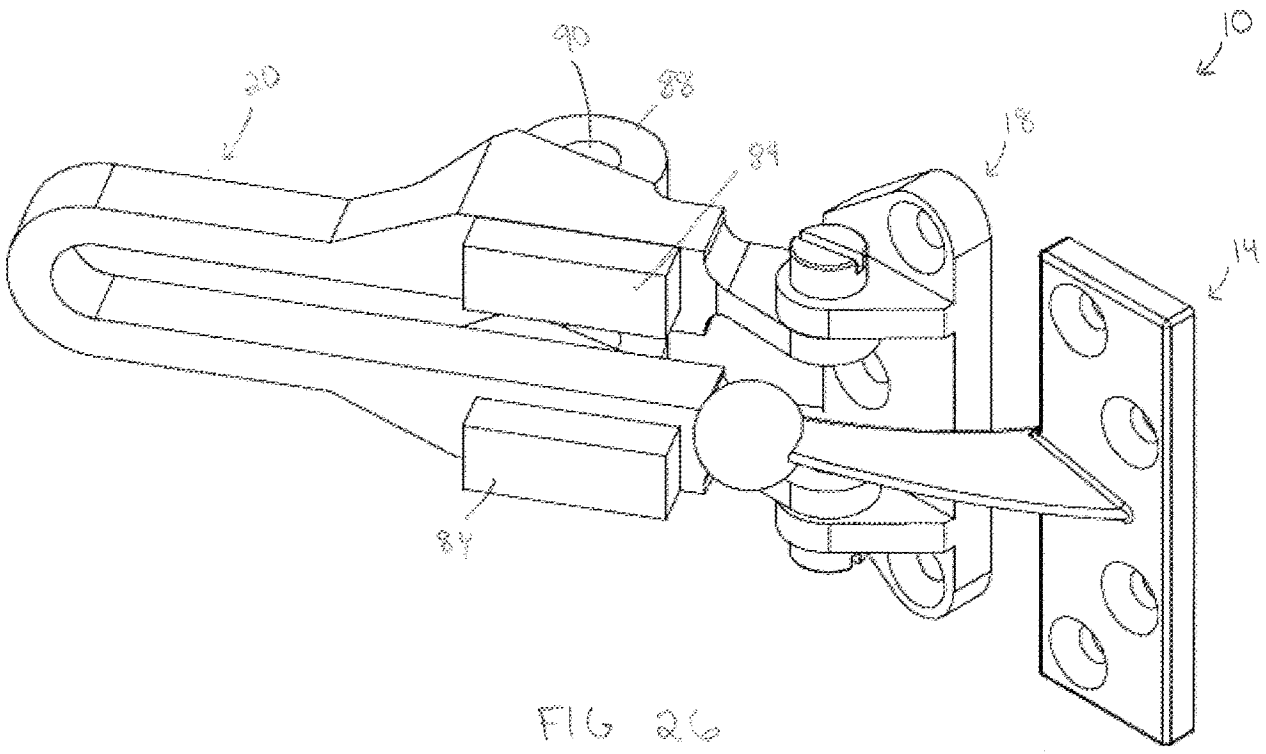
FIG. 26 is a perspective view of an exemplary swing bar door guard in an unlatched position.
Figure 27:
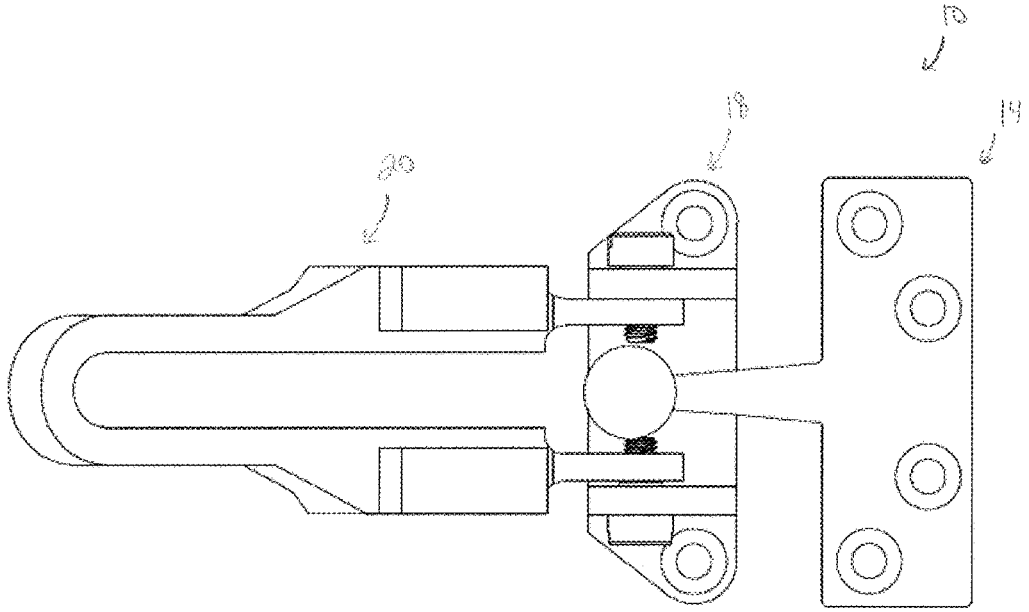
FIG. 27 is front view of the swing bar door guard in the unlatched position.
Figure 28:
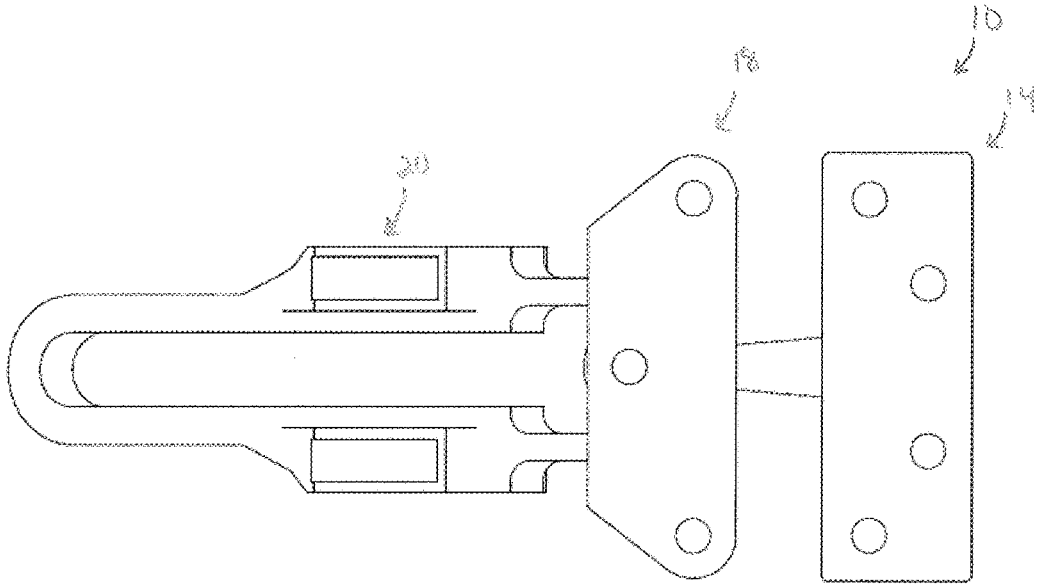
FIG. 28 is a rear view of the swing bar door guard in the unlatched position.
Figure 29:
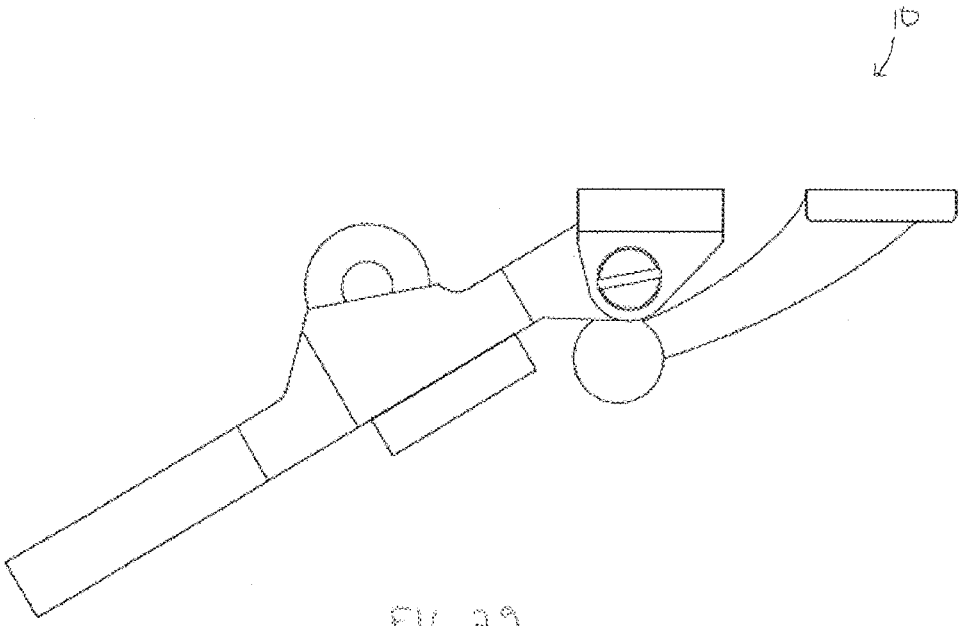
FIG. 29 is a top view of the swing bar door guard in the unlatched position.
Figure 30:
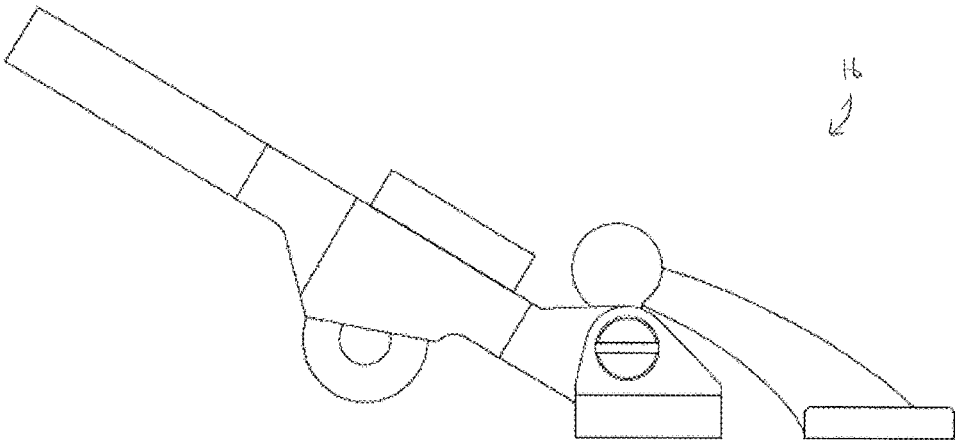
FIG. 30 is a bottom view of the swing bar door guard in the unlatched position.
Figure 31:
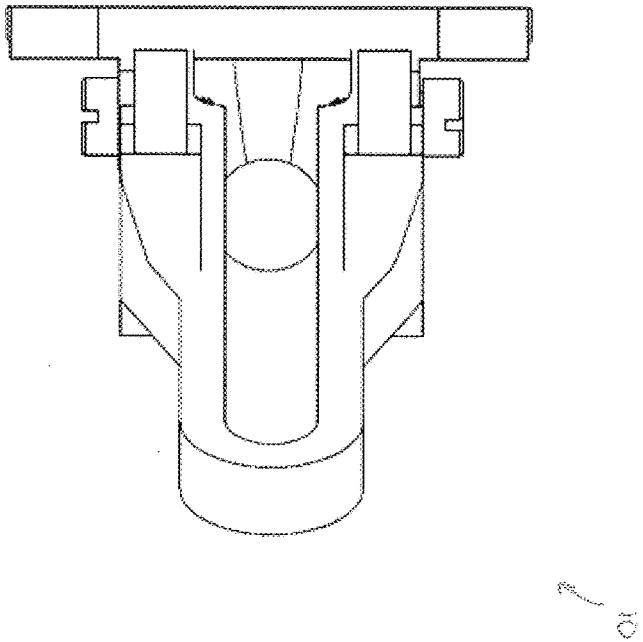
FIG. 31 is a left side view of the swing bar door guard in the unlatched position.
Figure 32:
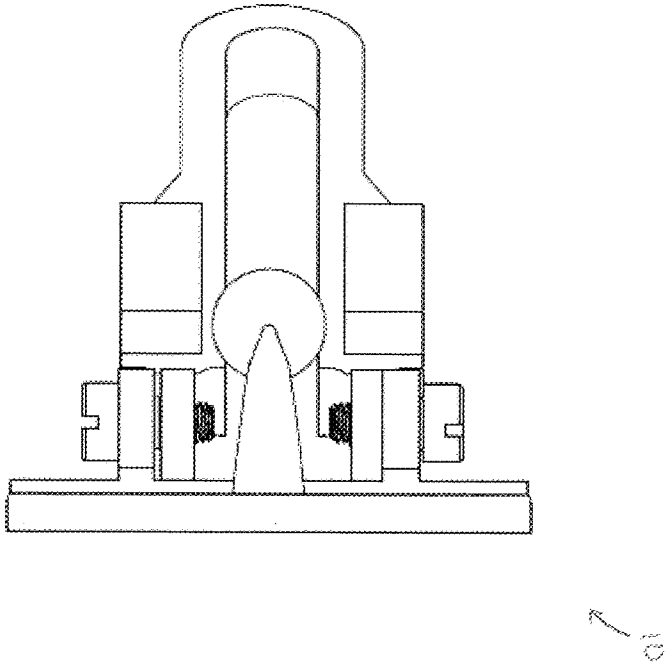
FIG. 32 is a right side view of the swing bar door guard in the unlatched position.

Referring additionally to FIGS. 15-18, the latch bar 20 has a pair of parallel bar members 50 and 52 connected by a curved member 54 such that the latch bar 20 has a shape that is substantially an elongate U. The latch bar also includes a protrusion 56, 58 extending from a top surface of each of the bar members 50 and 52 and an opening 60, 62 extending through each bar member 50, 52 and its respective protrusion 56, 58. As shown the bar members 50 and 52, the curved member 54, and the protrusions 56 and 58 are one piece. As shown in FIG. 17, each opening 60, 62 has a first portion 64 with a first length L1 and a second portion 66 with a second length L2 greater than the first length. The second portion 66 has a curved shape at a bottom thereof having a first radius for receiving a circular portion of a bumper. The first radius is equal to half the second length. The protrusions are angled relative to the top surfaces of the bar members 50 and 52 to allow a face of the door 16 to contact bumpers on the latch bar 20 rather than an edge of the door when the swing bar door guard is in a blocking position. The protrusions 56 and 58 are angled outward from the bar members 50 and 52 in a direction from an end of the bar members 50 and 52 opposite the curved member 54 toward the curved member 54.

Extending from the ends of the parallel bar members 50 and 52 opposite the curved member 54 are respective ears 70 and 72. Each ear 70, 72 is configured to abut the respective ear 28, 30 of the latch base 18 and has a respective openings 74, 76 configured to be aligned with the respective opening 32, 34 in the ears 28 and 30 of the latch base 18. The openings 74 and 76 are threaded to engage threads of the fasteners 36 and 38.

Referring additionally to FIGS. 19-25, the door latch 12 additionally includes a pair of bumpers 80 and 82 configured to be received in and extend past each end of the openings 60 and 62 to reduce or eliminate noise when the swing bar door guard is in the blocking position. Each bumper 80 includes a base 84, also referred to as a jamb bumper, having a third length greater than the first and second lengths, a post 86 extending from the base 84 having a fourth length less than or equal to the first length, and a substantially circular portion 88, also referred to as a door bumper, extending from the post 86 and having a second radius less than or equal to the first radius. The circular portion 88 has an opening 90 extending therethrough that allows the circular portion to deflect downward during installation and in use.

To assembly the door latch 12 as shown in FIG. 1, the openings 74 and 76 in the latch bar 20 are aligned with the respective openings 32 and 34 in the latch base 18 either before or after the latch base 18 has been attached to the door jamb 22. The fastener 36 is then inserted through the opening 32 and threaded through the opening 74 to connect the ear 28 to the ear 70, and the fastener 38 is inserted through the opening 34 and threaded through the opening 76 to connect the ear 30 to the ear 72.

Before or after attachment of the latch bar 20 to the latch base 18, the bumpers 80 and 82 are attached to the latch bar 20. To attach the bumper 80, the door bumper 88 is inserted into the first portion 64 of the opening 60 from the backside of the bar member 50. The door bumper 88 is compressed to fit through the first portion 64 and is advanced into the second portion 66 where the door bumper 88 expands to sit within the second portion 66 and extend out of the opening 60. In this position the post 86 is disposed in the first portion 64 and the jamb bumper 84 abuts the bottom surface of the bar member 50. The jamb bumper 84 has the third length greater than the first length to prevent the bumper 80 from being pulled out in one direction, and the door bumper 88 is sized to be larger than the first length to resist unintentional removal in the other direction. If a user desires to replace the bumper 80, the user grasps the jamb bumper 84 and pulls to cause the door bumper 88 to compress to allow removal.

Similar to the bumper 80, to attach the bumper 82 the door bumper 88 is inserted into the first portion 64 of the opening 62 from the backside of the bar member 52. The door bumper 88 is compressed to fit through the first portion 64 and is advanced into the second portion 66 where the door bumper 88 expands to sit within the second portion 66 and extend out of the opening 62. In this position the post 86 is disposed in the first portion 64 and the jamb bumper 84 abuts the bottom surface of the bar member 52.

Referring again to FIG. 2, the door hook 14 includes a body 100 having a bottom surface that abuts the door 16 and one or more openings 102, such as four openings as shown, for receiving fasteners to secure the body 100 to the door 16. The openings 102 can be countersunk to receive a head of the fasteners. The door hook also includes an arm 104 extending from the body 100 with a knob 106 at an end of the arm 104.

Figure 9:
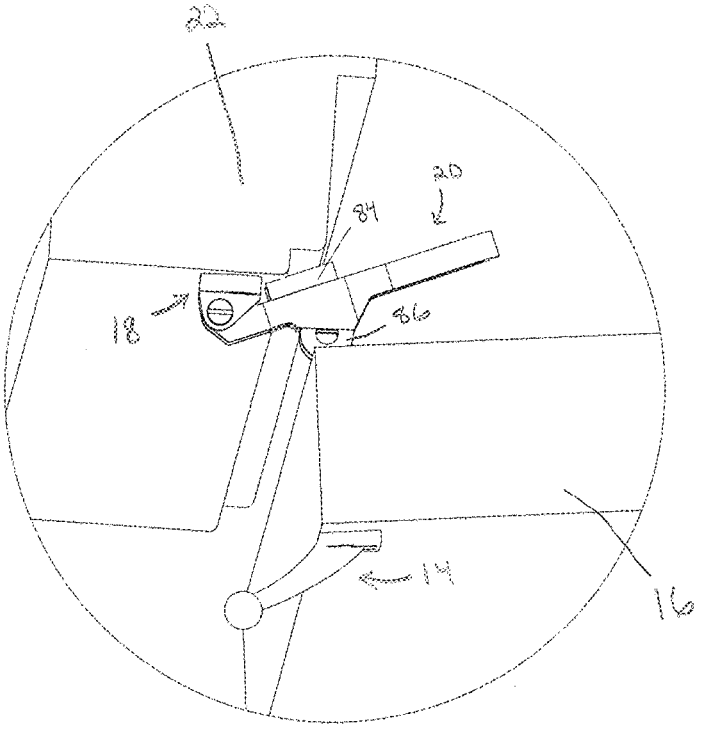
FIG. 9 is a top view of the swing bar door guard installed on a door jamb and in a blocking position.
Figure 10:
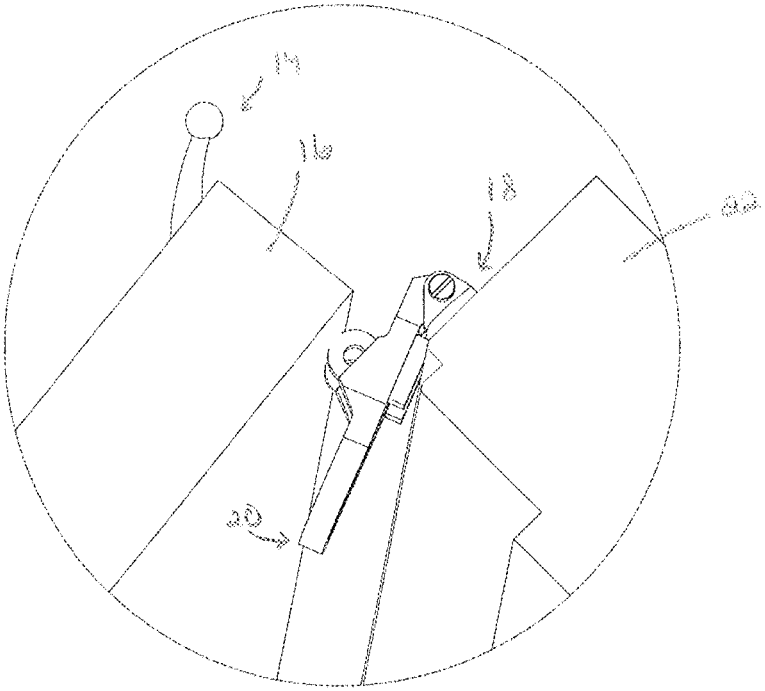
FIG. 10 is another top view of the swing bar door guard installed on a door jamb and in the blocking position.
Figure 11:
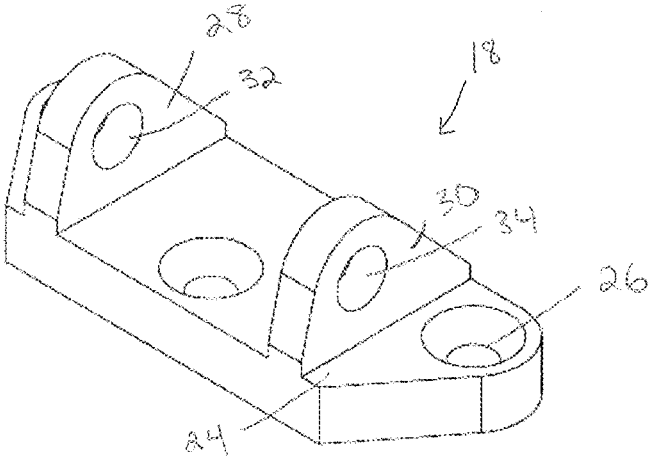
FIG. 11 is a perspective view of a latch base of the swing bar door guard.
Figure 12:
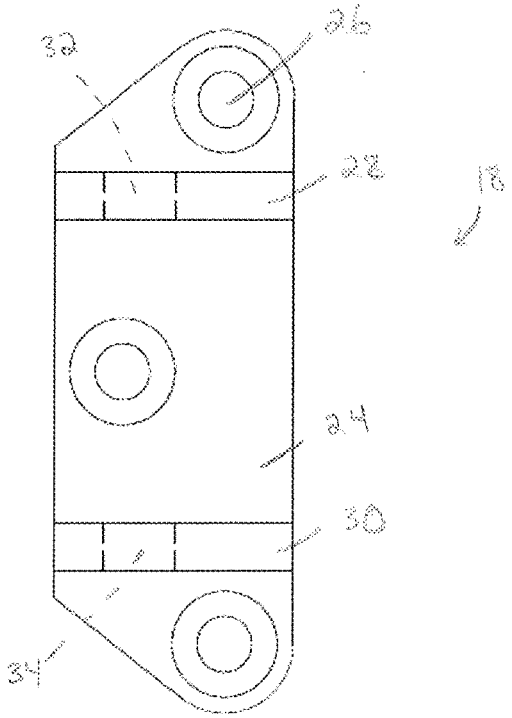
FIG. 12 is a top view of the latch base.
Figure 13:
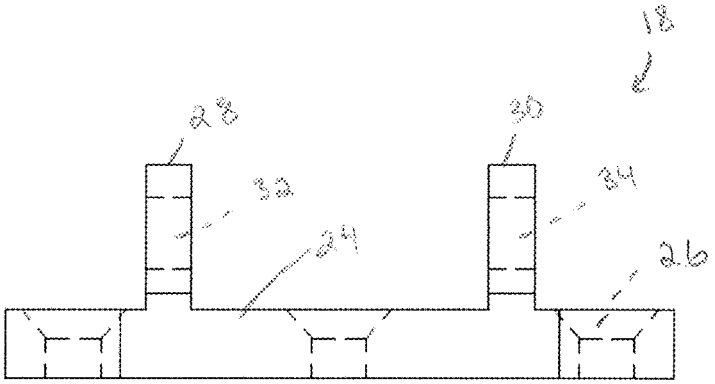
FIG. 13 is a left side view of the latch base.
Figure 14:
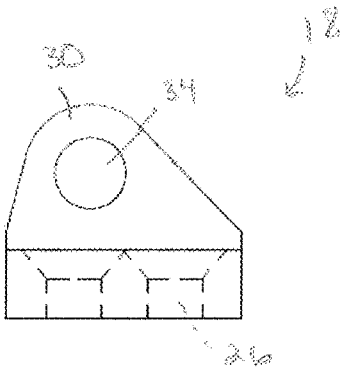
FIG. 14 is a front view of the latch base.
Figure 15:
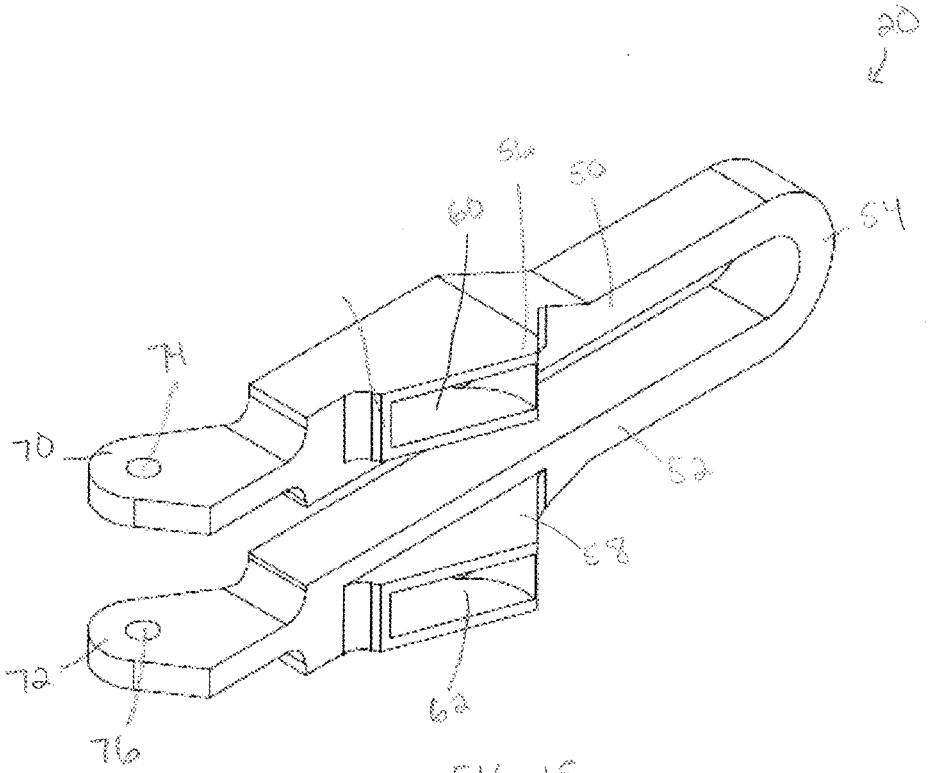
FIG. 15 is a perspective view of a latch bar of the swing bar door guard.
Figure 16:
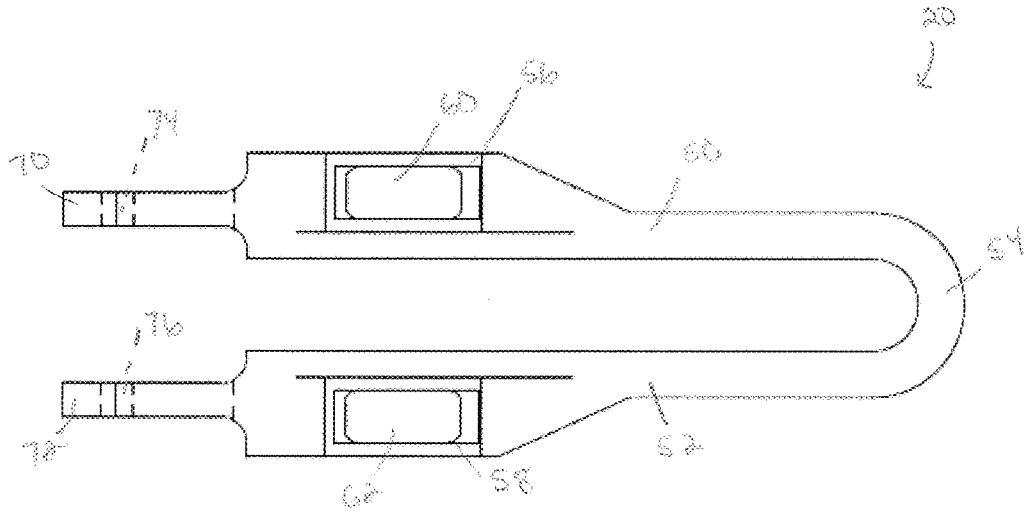
FIG. 16 is a front view of the latch bar.

To attach the swing bar door guard 10 to the door 16 and door jamb 22 as shown in FIGS. 9 and 10, the door hook 14 is attached to the door 16 and the latch base 18 is attached to the door jamb 22 in any order. For example, the bottom surface of the body 24 of the latch base 18 is placed against the door jamb 22 and the fasteners inserted through the openings 26 to secure the latch base 18 to the door jamb 22, and the bottom surface of the body 100 of the door hook 14 is placed against the door 16 and the fasteners inserted through the openings 102 to secure the door hook 14 to the door 16. The door hook 14 and the door latch 12 are aligned relative to another such that when the door 16 is in a closed position, the latch bar 20 can be moved over the arm 104 to prevent the door 16 from fully opening.

During use, the swing bar door guard, and in particular the latch bar 20, is movable between the latched position shown in FIG. 1, an unlatched position shown in FIGS. 26-32 where the latch bar 20 is moved away from the arm 104 to allow to door 16 to be opened and closed, and to the blocking position shown in FIGS. 9 and 10. To move the latch bar 20 to the blocking position, the latch bar 20 is moved away from the door 16 to the unlatched position to allow the door 16 to open. The latch bar 20 is then moved towards the door 16 when the door is in the opened position and movement is continued until the jamb bumpers 84 on the bumpers 80 and 82 contact the door jamb 22. When the door 16, which is typically an automatically closing door, is released, an outside face of the door 16 contacts the door bumpers 88 on the bumpers 80 and 82. The swing bar door guard 10 thereby prevents the door from being damaged by eliminating contact with a metal portion of a door guard and reduces or eliminates noise associated with a door slamming against the metal portion of the door guard and the door guard slamming against a door jamb.

By angling the protrusions 56 and 58 relative to the top surfaces of the bar members 50 and 52, the outside face of the door 16 contacts the door bumpers 88 in the blocking position rather than the edge of the door to more evenly distribute the impact force. The bumpers 80 and 82 thereby provide a direct load path from the door 16, through the bumpers 80 and 82, and into the door jamb 22 to reduce wear and tear on the swing bar door guard 10. By providing both the jamb bumpers 84 and the door bumpers 88, both the door 16 and door jamb 22 are protected and noise is reduced or prevented from contact with both the door 16 and door jamb 22.

Figure 33:
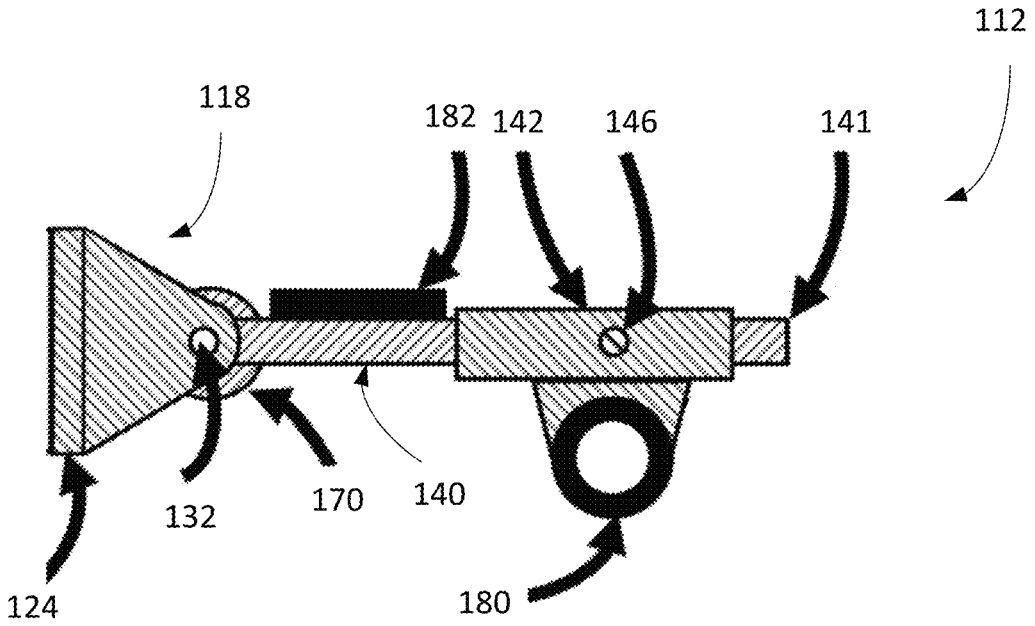
FIG. 33 is a top view of an exemplary door latch.
Figure 34:
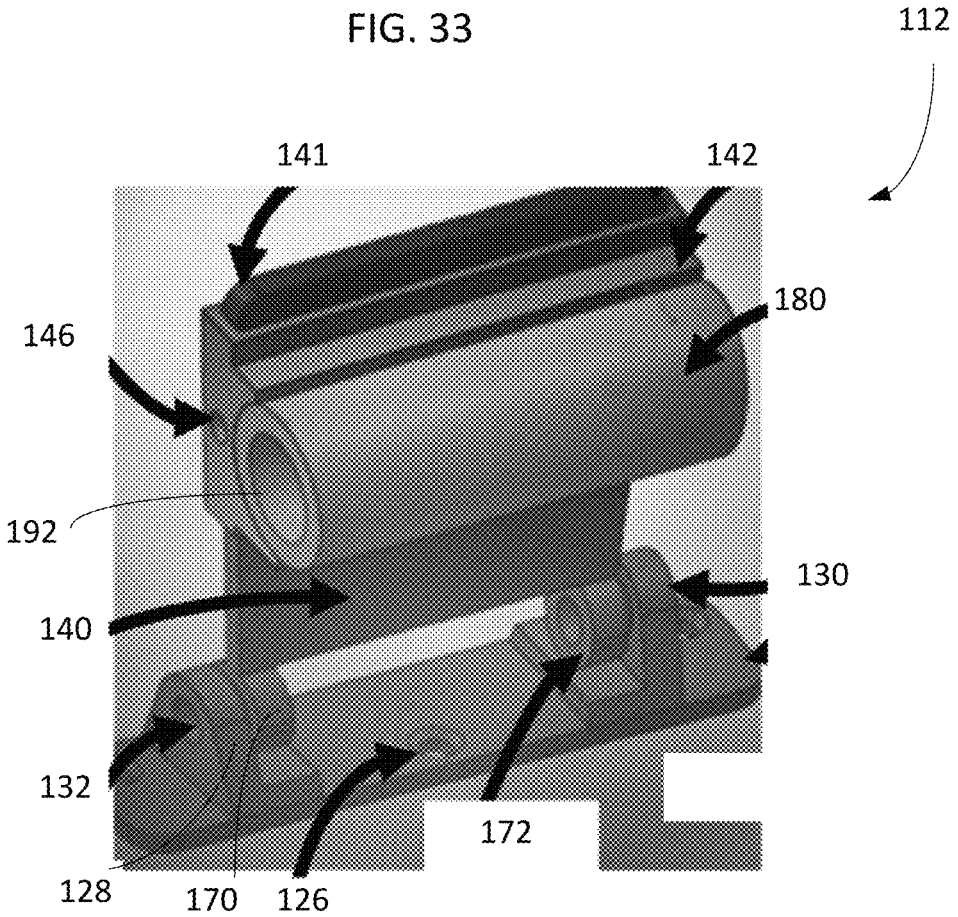
FIG. 34 is a perspective view of the door latch

Turning now to FIGS. 33 and 34, an exemplary embodiment of a door latch is shown at 112. The door latch 112 is substantially the same as the above-referenced latch bar 112, and consequently the same reference numerals but indexed by 100 are used to denote structures corresponding to similar structures in the door latches. In addition, the foregoing description of the door latch 12 is equally applicable to the door latch 112 except as noted below.

The door latch 112 includes a latch base 118 and a latch bar 120 configured to be coupled to the latch base 118. The latch base 118 includes a body 124 with one or more openings 126 for receiving fasteners, and a pair of ears 128 and 130 extending from a top surface of the body 124 and having a respective opening 132 for receiving a respective fastener for securing the latch bar 120 to the latch base 118.

The latch bar 120 includes a base 140, an adjustable retainer 142 movable relative to the base to adjust a length of the latch bar 120, a bumper 180 attached to the adjustable retainer 142 and having an opening 190 extending therethrough, and a bumper 182 attached to the base 140. The latch bar 120 includes ears 170 and 172 for aligning with the ears on the latch base 118. The adjustable retainer 142 may be held in position relative to the base 140 by a fastener 146, such as a set screw, and includes a through passage through which the base moves. An end 141 of the base is shown extending through the passage.

Figure 35:
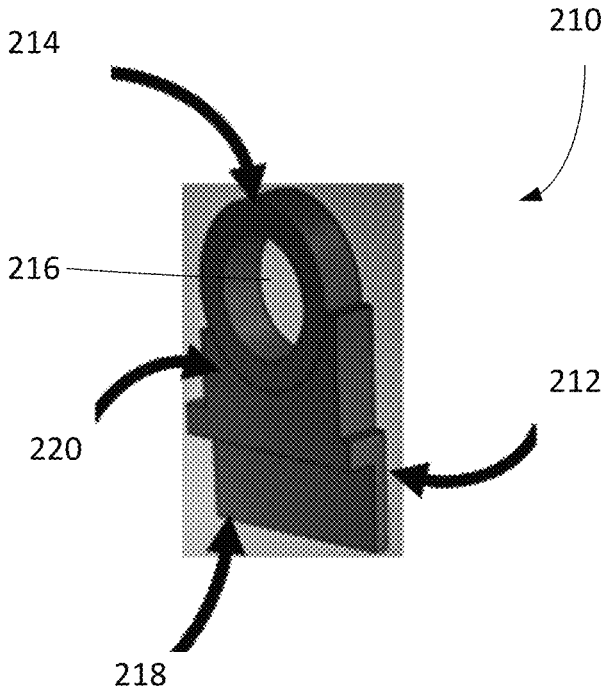
FIG. 35 is a perspective view of an exemplary bumper assembly.

Turning now to FIG. 35, an exemplary bumper assembly is shown at 210. The bumper assembly 210 may be attached to a latch bar, such as a latch bar having a pair of parallel bar members. The bumper assembly 210 includes a body 212 and a bumper 214 attached to the body 212. The bumper 214 includes an opening 216 extending therethrough to assist in deflection of the bumper. The body 212 has an L-shaped portion 218 for attachment to one of the bar members and a protrusion portion 220 to which the bumper attaches.

Although certain embodiments have been shown and described, it is understood that equivalents and modifications falling within the scope of the appended claims will occur to others who are skilled in the art upon the reading and understanding of this specification.

What is claimed is:

1. A swing bar door guard comprising:

a door latch including:

a latch base configured to be connected to a door jamb, a latch bar configured to be connected to the latch base, the latch bar including a body having a top surface, a bottom surface configured to face a door in a latched position, and a first and a second opening each extending through the body and opening to the top and bottom surfaces, and a first bumper and a second bumper extending through the first and second openings respectively and being removably attached to the latch bar, the first and second bumpers each having a jamb bumper portion and a door bumper portion; and a door hook configured to be connected to the door, wherein the latch bar is movable between an unlatched position to allow opening and closing of the door, the latched position to prevent full opening of the door, and a blocking position to prevent closing of the door, and wherein in the blocking position, the jamb bumper portion contacts the door jamb and the door bumper portion contacts the door.

2. The swing bar door guard according to claim 1, wherein the body has a first parallel bar member and a second parallel bar member and the first opening and the second opening extend through the first and second parallel bar members respectively.

3. The swing bar door guard according to claim 2, wherein the first and second bumpers extend through the first and second openings respectively such that the jamb bumper portion extends past one end of the respective first and second opening to contact the door jamb, and the door bumper portion extends past another end of the respective first and second opening to contact the door.

4. The swing bar door guard according to claim 3, wherein each door bumper portion includes a circular portion having an opening extending therethrough.

5. The swing bar door guard according to claim 3, wherein the first and second bumpers each include the jamb bumper portion, the door bumper portion, and a post connecting the jamb bumper portion and the door bumper portion.

6. The swing bar door guard according to claim 3, wherein each jamb bumper portion has a length greater than a length of the respective first and second opening in the first and second parallel bar members to block the jamb bumper portion from entering the respective opening.

7. The swing bar door guard according to claim 3, further including a first protrusion and a second protrusion extending respectively in a direction away from the top surface of the first and second parallel bar members, wherein the first and second openings additionally extend through the first and second protrusions respectively.

8. The swing bar door guard according to claim 7, wherein the first and second protrusions are angled relative to a plane of the top surface of the body such that an axis of each opening extending through the first and second protrusions is non-perpendicular with the plane.

9. The swing bar door guard according to claim 1, wherein the latch base includes a body having a bottom surface configured to abut the door jamb, one or more openings extending through the body for receiving fasteners to secure the body to the door jamb, a pair of ears extending from a top surface of the body parallel to one another and spaced from one another along a length of the body, and an opening extending through each ear.

10. The swing bar door guard according to claim 1, wherein the door hook includes a body having a bottom surface configured to abut the door, one or more openings extending through the body for receiving fasteners to secure the body to the door, an arm extending from the body, and a knob at an end of the arm.

11. A door latch for use with a door hook, the latch comprising:

a latch bar including a body having a pair of parallel bar members each having a top surface configured to face away from a door in a latched position and a bottom surface configured to face the door in the latched position, a protrusion extending from the top surface of each of the parallel bar members, an opening extending through each parallel bar member and respective protrusion and opening to the top and bottom surfaces, an ear extending from ends of each parallel bar member, and an opening extending through each ear for connecting the latch bar to a latch base; and a pair of bumpers configured to extend through a respective one of the openings, each bumper including a jamb bumper portion configured to contact a door jamb and a door bumper portion configured to contact a door.

12. The door latch according to claim 11, further including the latch base including a body having a bottom surface configured to abut the door jamb, one or more openings extending through the body for receiving fasteners to secure the body to the door jamb, a pair of ears extending from a top surface of the body parallel to one another and spaced from one another along a length of the body, and an opening extending through each ear for aligning with a respective one of the openings in the ears of the parallel bar members.

13. The door latch according to claim 11, wherein each protrusion extends for the top surface of the respective parallel bar member at an angle relative to a plane of the top surface of the body such that an axis of each opening extending through the protrusions is non-perpendicular with the plane.

14. The door latch according to claim 11, wherein each door bumper portion includes a circular portion having an opening extending therethrough.

* * * * *